United States Patent [19]

Fujita

[11] 4,382,697

[45] May 10, 1983

[54] ELECTRONIC TIMEPIECE

[75] Inventor: Masanori Fujita, Tokyo, Japan

[73] Assignee: Seikosha Co., Ltd., Japan

[21] Appl. No.: 375,989

[22] Filed: May 7, 1982

Related U.S. Application Data

[63] Continuation of Ser. No. 124,950, Feb. 26, 1980, abandoned.

[30] Foreign Application Priority Data

Feb. 27, 1979 [JP] Japan ..... 54-22334

[51] Int. Cl.[3] ..... G04C 17/02

[52] U.S. Cl. ..... 368/240

[58] Field of Search ..... 368/82–84, 368/239–242; 340/765, 756, 802; 350/332

[56] References Cited

U.S. PATENT DOCUMENTS

| | | | |
|---|---|---|---|
| 3,754,392 | 8/1973 | Daniels | 368/87 |
| 3,934,241 | 1/1976 | Weigert | 368/242 |
| 3,969,887 | 7/1976 | Fukumoto | 368/242 |
| 3,975,726 | 8/1976 | Kawakami | 340/802 |
| 3,987,617 | 10/1976 | Slob | 368/240 |
| 4,076,385 | 2/1978 | Kondo | 340/765 |
| 4,212,159 | 7/1980 | Noble et al. | 368/82 |

*Primary Examiner*—Vit W. Miska

*Attorney, Agent, or Firm*—Robert E. Burns; Emmanuel J. Lobato; Bruce L. Adams

[57] ABSTRACT

An electronic timepiece in which an optical hand display device is composed of a plurality of segment electrodes of the shape of hands that are radially arrayed and opposing common electrodes that are divided into groups via a liquid crystal, the segment electrodes located at predetermined positions are electrically connected together, the segment electrodes being divided into groups each consisting of a predetermined number of segment electrodes, and time information is displayed by hands for each predetermined digits in a time-divisional manner. According to the electronic timepiece of the present invention, the number of terminals to the electrodes is reduced, and time can be clearly displayed by hands requiring reduced number of selection voltages.

2 Claims, 17 Drawing Figures

| $V_{s-c}$ \ $V_s$ / $V_c$ | | | $S_0$ | | $S_1$ | |
|---|---|---|---|---|---|---|
| | | | 0 | $3v_0$ | $2v_0$ | $v_0$ |
| $C_0$ | $3v_0$ | 0 | $-3v_0$ | $3v_0$ | $-v_0$ | $v_0$ |
| $C_1$ | $v_0$ | $2v_0$ | $-v_0$ | $v_0$ | $v_0$ | $-v_0$ |

| $V_{s-c}$ \ $V_s$ / $V_c$ | | | $S_0$ | | $S_1$ | |
|---|---|---|---|---|---|---|
| | | | $3v_0$ | 0 | $v_0$ | $2v_0$ |
| $C_0$ | 0 | $3v_0$ | $3v_0$ | $-3v_0$ | $v_0$ | $-v_0$ |
| $C_1$ | $2v_0$ | $v_0$ | $v_0$ | $-v_0$ | $-v_0$ | $v_0$ |

ELECTRONIC TIMEPIECE

This is a continuation of application Ser. No. 124,950, filed Feb. 26, 1980 which will be abandoned in favor of the continuation application.

BACKGROUND OF THE INVENTION

The present invention relates to an electronic timepiece which displays the lapse of time by an optical hand display portion. More specifically, the invention relates to an electronic timepiece which is simply constructed and which provides a clear display of time by hands.

Conventional display devices for the analog-type electronic timepieces can be roughly divided into those which mechanically display the time by hands and those which optically display the time without using hands. A representative example of the display device of the latter type has been composed of light-emitting elements such as light-emitting diodes that are circularly arrayed, and the light-emitting elements are turned on in a cumulative manner or the turn-on position is successively moved to display the lapse of time. However, many people are accustomed to the habit of reading the time by the relative positions of a long hand and a short hand. Accordingly, although the above-mentioned optical display may give ornamental effects, people find it difficult to quickly read the time which is an essential requirement for a timepiece. Attempts have therefore been made to realize the mode of display by hands, and such optical display devices are often found on the market. Being restricted by electronic circuits and display elements, however, most of such devices are not capable of perfectly displaying the time by hands, and make it difficult to quickly and correctly read the time.

SUMMARY OF THE INVENTION

A first object of the present invention is to provide a novel electronic timepiece which optically displays the time by hands.

A second object of the present invention is to provide an electronic timepiece in which segment electrodes are divided into groups, the segment electrodes at predetermined positions of each group are commonly connected together, and pulse signals are selectively fed, responsive to time-divided display information, to a hand display portion composed of the segment electrodes and common electrodes which are divided, requiring reduced number of terminals and reduced number of voltages for effecting the display, while increasing operation margin and reducing the consumption of electric power by semistatically driving the device for each information unit, and further maintaining constant the quantity of information that is to be displayed, such that there is no need of changing the voltage condition even when the quantity of information is increased to some extent.

BRIEF DESCRIPTION OF THE DRAWINGS

The nature of the present invention as well as other objects and advantages thereof will become more apparent from the following description taken in conjunction with the accompanying drawings in which.

DESCRIPTION OF THE PREFERRED EMBODIMENTS

Figure 1:
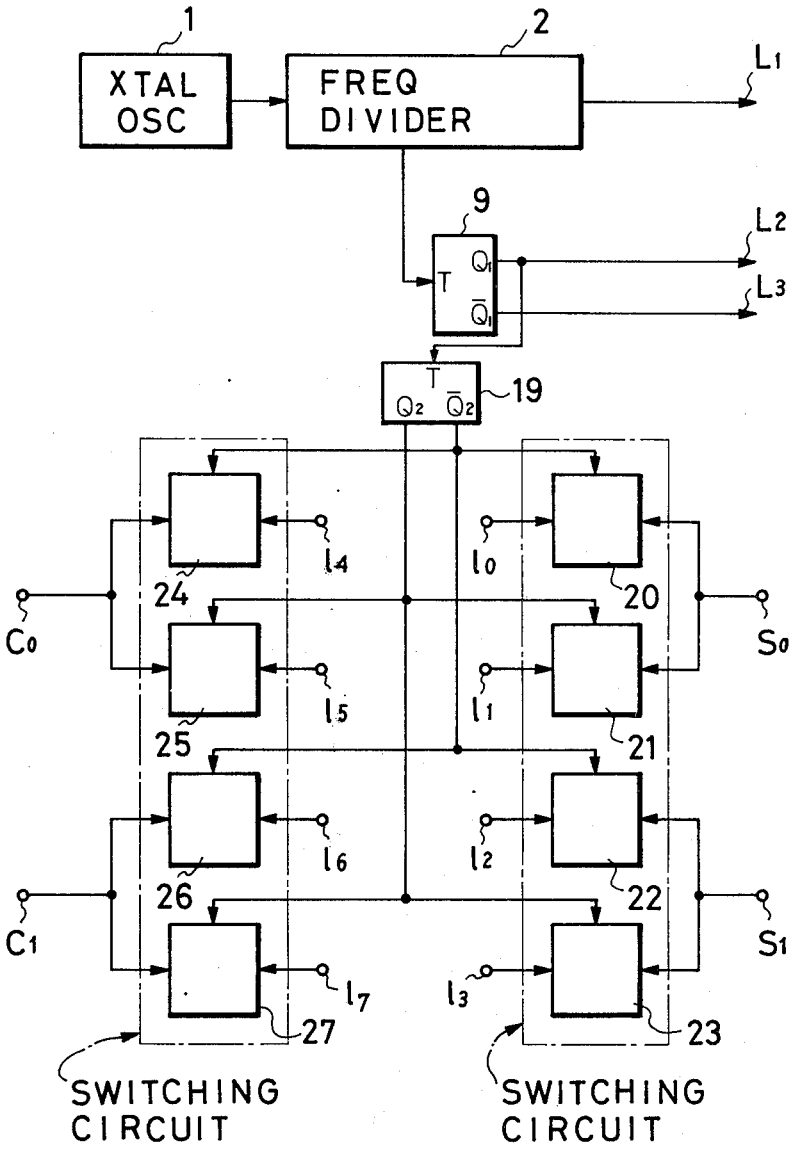
FIGS. 1 and 2 are block diagrams of electric circuits according to an embodiment of the present invention.
Figure 2:
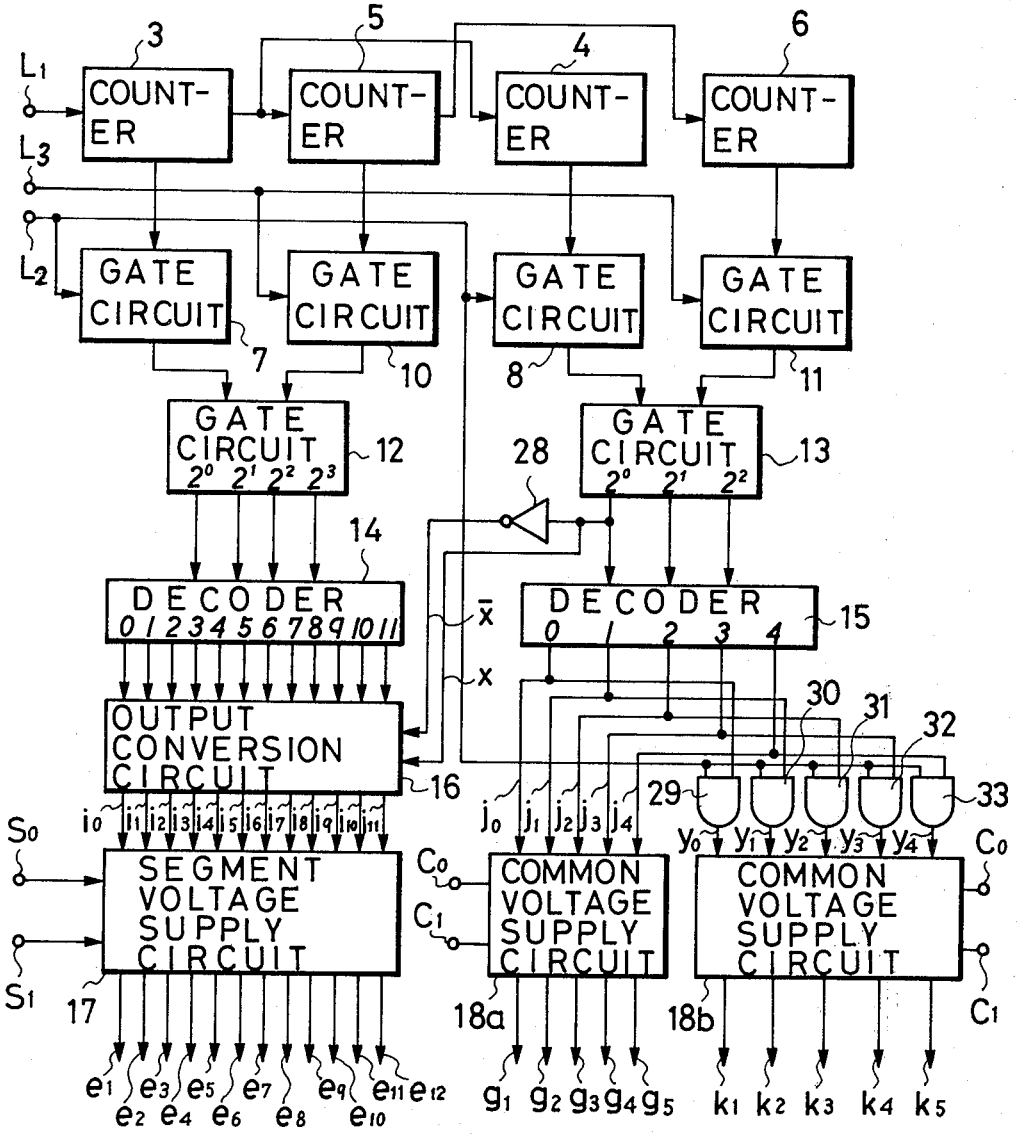

An embodiment of the present invention is described below with reference to the drawings. Referring to FIGS. 1 and 2, the output frequency of a crystal oscillator 1 is lowered by a frequency divider 2 and is fed to a duodecimal counter 3 which counts the minute digits of minute. A divide-by-five counter 4 receives a carry output of the counter 3 to count the minute digits of minute of a higher order. A duodecimal counter 5 and a divide-by-five counter 6 count the hour digits. All of the above-mentioned counters produce binary coded decimal outputs. Gate circuits 7 and 8 having an AND logic function receive the output of a flip-flop circuit 9 to control the passage of outputs of the counters 3 and 4. Gate circuits 10 and 11 having an AND logic function also receive the output of the flip-flop circuit 9 to control the passage of outputs of the counters 5 and 6. The outputs of gate circuits 7, 10 and gate circuits 8, 11, are fed to decoders 14 and 15 via gate circuits 12 and 13 having an OR logic function. An output conversion circuit 16 works to change the order of outputs from the decoder 14. This circuit 16 is necessary from the standpoint of wiring of electrodes that will be mentioned later. A segment voltage supply circuit 17 sets voltages that are to be applied to segment electrodes of a display device, and common voltage supply circuits 18*a* and 18*b* set voltages that are to be applied to common electrodes of the display device. A flip-flop circuit 19 is triggered by the output of the flip-flop circuit 9, and produces an output to control the on and off operations of switching circuits 20 to 27 which are composed of semiconductors or the like. Reference numeral 28 represents an inverter, and reference numerals 29 to 33 represent AND gate circuits.

Figure 3:
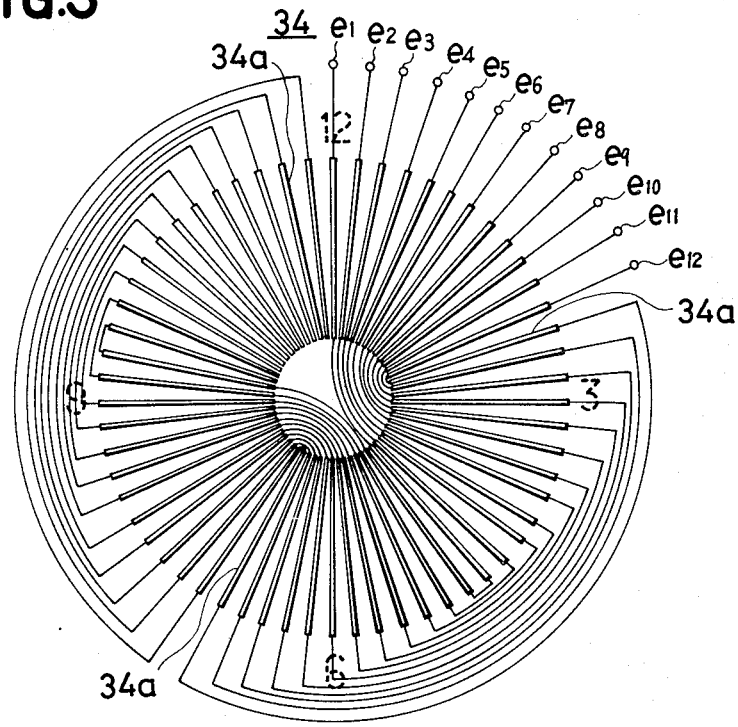
FIG. 3 is a plan view showing an array pattern of segment electrodes.

FIG. 3 illustrates, as generally designated at 34, the arrangement of sixty (60) segment electrodes of a number of 60. Twelve other electrodes 34*a*—34*a* are connected to terminals $e_1$ to $e_{12}$ of the segment supply circuit 17. Other segment electrodes are connected as mentioned below. In this embodiment, the order of the segment electrodes is counted in the clockwise direction starting with the segment electrode 34*a* connected to the terminal $e_1$ as the first one. A 12th segment electrode 34*a* is connected to a 13th segment electrode 34*a*, an 11th segment electrode is connected to a 14th electrode, —the 1st electrode is connected to a 24th electrode, the 24th electrode is connected to a 25th electrode, a 23th electrode is connected to a 26th electrode, —and the 13th electrode is connected to a 36th electrode. Thus, up to sixty segment electrodes are connected maintaining the same relation as described above.

Figure 4:
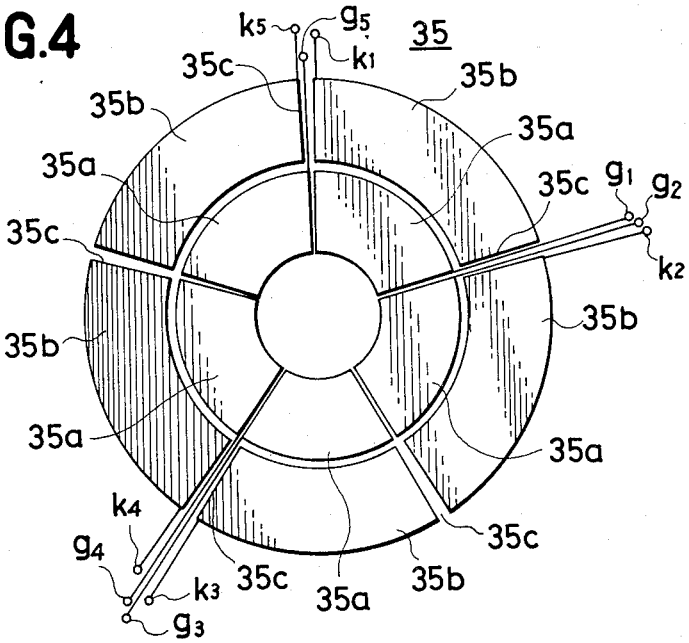
FIG. 4 is a plan view showing an array pattern of common electrodes.

FIG. 4 shows a pattern 35 of common electrodes 35*a* and 35*b* which are divided into five pairs with one located on the outer side and one on the inner side of the pattern 35.

Grooves 35*c*—35*c* for dividing the common electrodes 35*a*, 35*b* are located between the 12th segment electrode and the 13th segment electrode, between the 24th electrode and the 25th electrode, between the 36th electrode and the 37th electrode, between the 48th electrode and 49th electrode, and between the 60th segment electrode and the 1st segment electrode as counted in the clockwise direction.

The liquid crystal display device is composed of an aggregate of display portions which comprise a liquid crystal interposed between segment electrodes and common electrodes, and can be easily constructed by those skilled in the art.

Figure 5:
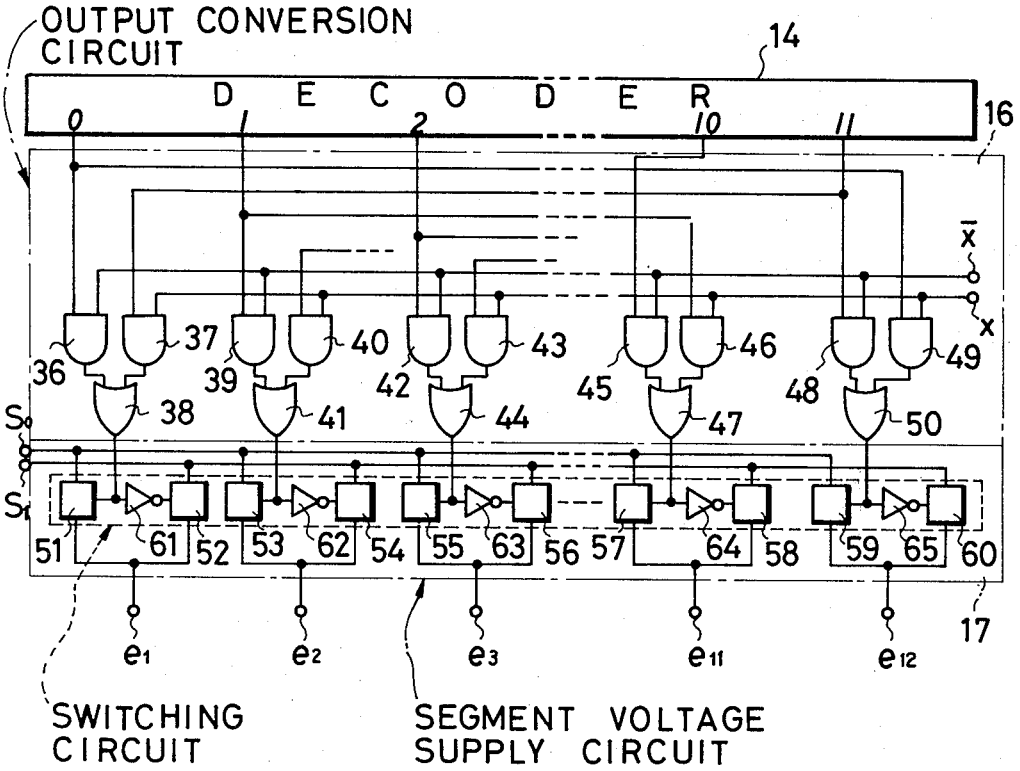
FIG. 5 is a block diagram illustrating in detail an output conversion circuit and a segment voltage supply circuit shown in FIG. 2.

FIG. 5 illustrates in detail the output conversion circuit 16 and the segment voltage supply circuit 17 of FIG. 1, in which reference numerals 36 to 50 denote AND gate and OR gate circuits, 51 to 60 denote switching circuits which are the same as those of FIG. 1, and 61 to 65 denote inverters.

Figure 6:
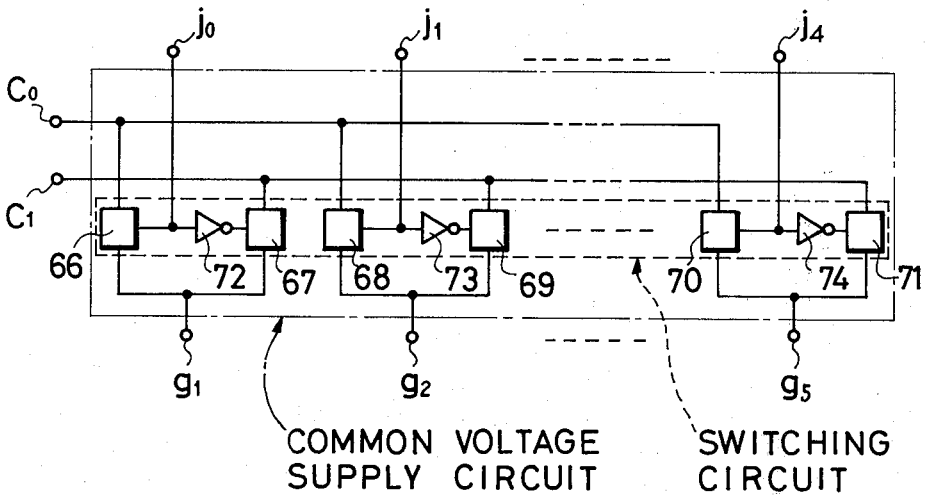
FIG. 6 is a block diagram illustrating in detail a common voltage supply circuit of FIG. 2.

FIG. 6 illustrates in detail the common voltage supply circuit 18*a*, in which reference numerals 66 to 71 denote switching circuits which are the same as those of FIG. 1, and 72 to 74 denote inverters.

The common voltage supply circuit 18*b* is also constructed in the same manner as above.

Figures 7, 8:
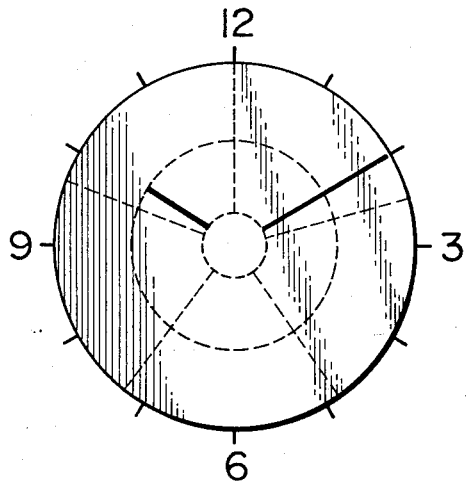
FIG. 7 is a diagram of voltage for illustrating the operation of FIG. 1.
FIG. 8 is a view showing the state in which time is displayed by hands.

Below are illustrated voltages generated on terminals $S_0$, $S_1$ of FIG. 1 that are to be applied to the segment electrodes, voltages generated on terminals $C_0$, $C_1$ that are to be applied to the common electrodes, and voltages between the segment and common electrodes. Predetermined voltages 0, $v_0$, $2v_0$ and $3v_0$ are selectively applied to the segment electrodes and the common electrodes, and it is presumed in this embodiment that the liquid crystal display device discontinues to turn on when the applied voltage is $|v_0|$ or less and is turned on when the applied voltage is $3|v_0|$ or more. The voltage $3v_0$ is applied to terminals $\mathbf{1}_0$, $\mathbf{1}_5$ of the switching circuits 20, 25, the voltage $2v_0$ is applied to terminals $\mathbf{1}_3$, $\mathbf{1}_6$, the voltage $v_0$ is applied to terminals $\mathbf{1}_2$, $\mathbf{1}_7$, and the voltage 0 is applied to terminals $\mathbf{1}_1$ and $\mathbf{1}_4$. Therefore, when the switching circuits 20 to 27 are switched by outputs $Q_2$ and $\overline{Q}_2$ of the flip-flop circuit 19 which is triggered by the output of the flip-flop circuit 9, voltage produced at the terminals $S_0$, $S_1$, $C_0$, $C_1$, and voltages between both terminals become as shown in the Table of FIG. 7. Referring to the Table, voltages Vs are those which may be assumed by the terminals $S_0$, $S_1$, and voltages Vc are those which may be assumed by the terminals $C_0$, $C_1$. Among these two groups of voltages, those on the left side are voltages that will be produced at each of the terminals when the output $Q_2$ of the flip-flop circuit 19 has a logical value "1" (hereinafter simply referred to a logic "1"), and those on the right side are voltages that will be produced at each of the terminals when the output $\overline{Q}_2$ is a logic "1". Moreover, voltages Vs-c represent values between terminals $S_0$, $S_1$ and terminals $C_0$, $C_1$. It will be obvious that the display portion is turned on by a voltage produced across the terminals $S_0$ and $C_0$.

Below is mentioned the display operation of the counters 3 to 6 when they have counted a time of 10 minutes past 10 o'clock. In this case, the minute counters 3, 4 count "10" and "0", respectively, and the hour counters 5, 6 count "2" and "4", respectively. The gate circuits 7 and 8 are opened for each "1" which periodically develops at the output $Q_1$ of the flip-flop circuit 9 which is energized by the output of the frequency divider 2, whereby minute data of counters 3, 4 is selected, and binary coded decimal values of "10" and "0" are produced at the outputs of the gate circuits 12, 13, respectively. Namely, a logic "1" is produced on terminals of $2^1$ and $2^3$ of the gate circuit 12, and a logic "0" is produced on terminals of $2^0$ to $2^2$ of the gate circuit 13. Therefore, a level on a line $\overline{X}$ is kept at a logic "1" and a level on a line X at a logic "0".

Outputs of the gate circuits 12 and 13 are converted by the decoders 14, 15, whereby a logic "1" is produced on a terminal of "10" of the decoder 14 and a logic "1" is produced on a terminal of "0" of the decoder 15. Referring to FIG. 5, since a level on the line $\overline{X}$ is kept at a logic "1", the output of the gate circuit 45 is a logic "1", and hence, the output of the gate circuit 47 is a logic "1", the switching circuit 57 is turned on, and a voltage produced on the terminal $S_0$ is applied to a terminal $e_{11}$ of a segment electrode. On the other hand, the outputs of the other gate circuits, i.e., the outputs of the gate circuits 38, 41, 44, —50 are all logic "0" and hence the switching circuits 52, 54, 56, —60 are turned on, and a voltage produced on the terminal $S_1$ is applied to the terminals $e_1$ to $e_{10}$, $e_{12}$.

Since a level on a terminal $j_0$ of the decoder 15 is kept at a logic "1", a switching circuit 66 in FIG. 6 is turned on, and a voltage produced on the terminal $C_0$ is applied to a terminal $g_1$ of common electrode. Further, since the switching circuits 69, —71 are turned on, a voltage produced on the terminal $C_1$ is applied to terminals $g_2$ to $g_5$.

Furthermore, since the output $Q_1$ of the flip-flop circuit 9 of FIG. 1 is a logic "1", a level on an output terminal $y_0$ of the gate circuit 29 comes to a logic "1". Therefore, as will be obvious from the common voltage supply circuit 18*a* shown in FIG. 6 which is constructed in the same manner as the common voltage supply circuit 18*b*, a voltage produced on the terminal $C_0$ is applied to a terminal $k_1$ and a voltage produced on the terminal $C_1$ is applied to terminals $k_2$ to $k_5$.

From the relations of voltages at each of the terminals shown in FIG. 7, a display portion will be turned on, which is composed of a segment electrode connected to the terminal $e_{11}$ and a common electrode connected to terminals $k_1$ and $g_1$. Then, hour data of the counters 5, 6 is selected for each periodical development of a logic "1" in the output $\overline{Q}_1$ of the flip-flop circuit 9 of FIG. 1, so that a logic "1" is produced on a terminal "2" of the decoder 14 and a logic "1" is produced on a terminal "4" of the decoder 15. Since a level on the terminal $2^0$ of the gate circuit 13 is kept at a logic "0", a level on the line X is kept at a logic "0" and that of the terminal $\overline{X}$ at a logic "1".

Referring to FIG. 5, the output of the gate circuit 42 is a logic "1", whereby the output of the gate circuit 44 is a logic "1" and the switching circuit 55 is turned on so that a voltage produced on the terminal $S_0$ is applied to the terminal $e_3$. A voltage produced on the terminal $S_1$ is applied to other terminals. Further, in FIG. 6, since a level on a terminal $j_4$ of the decoder 15 is kept a logic "1", a voltage produced on the terminal $C_0$ is applied to the terminal $g_5$, and a voltage produced on the terminal $C_1$ is applied to other terminals $g_1$ to $g_4$. Referring to FIG. 1 again, since the output $Q_1$ of the flip-flop circuit 9 is a logic "0", the outputs of the gate circuits 29 to 33 are all "0", and a voltage produced on the terminal $C_1$ is applied to the terminals $k_1$ to $k_5$.

Thus, the display portion consisting of a segment electrode connected to the terminal $e_3$ and a common electrode connected to the terminal $g_5$, is turned on.

FIG. 8 shows the state in which a time is indicated by hands.

Figure 9:
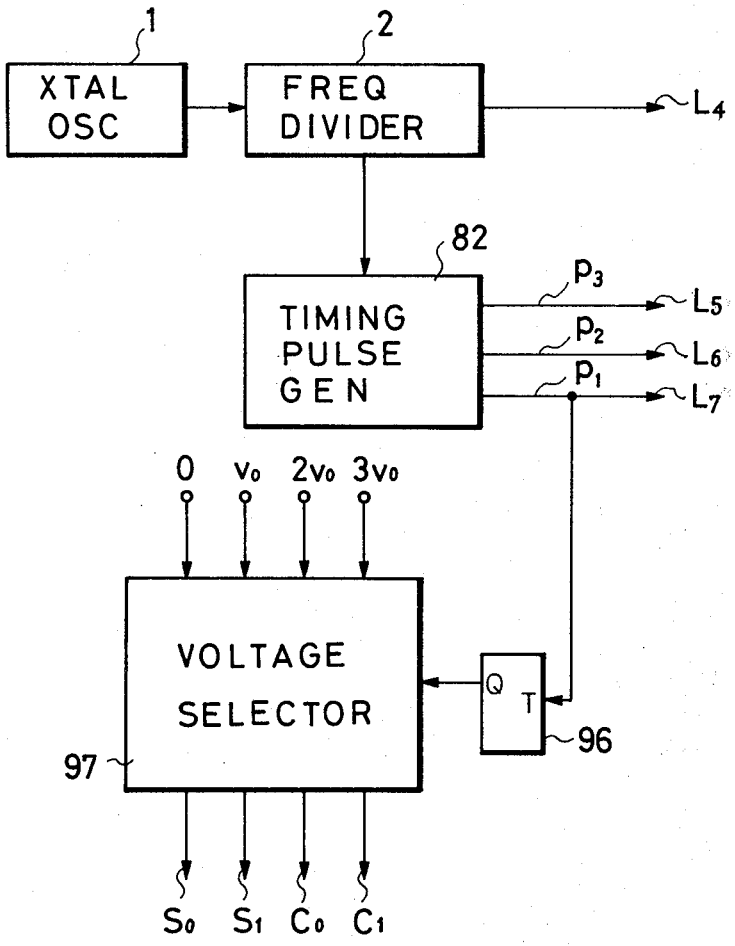
FIGS. 9 and 10 are block diagrams according to another embodiment of the present invention.
Figure 10:
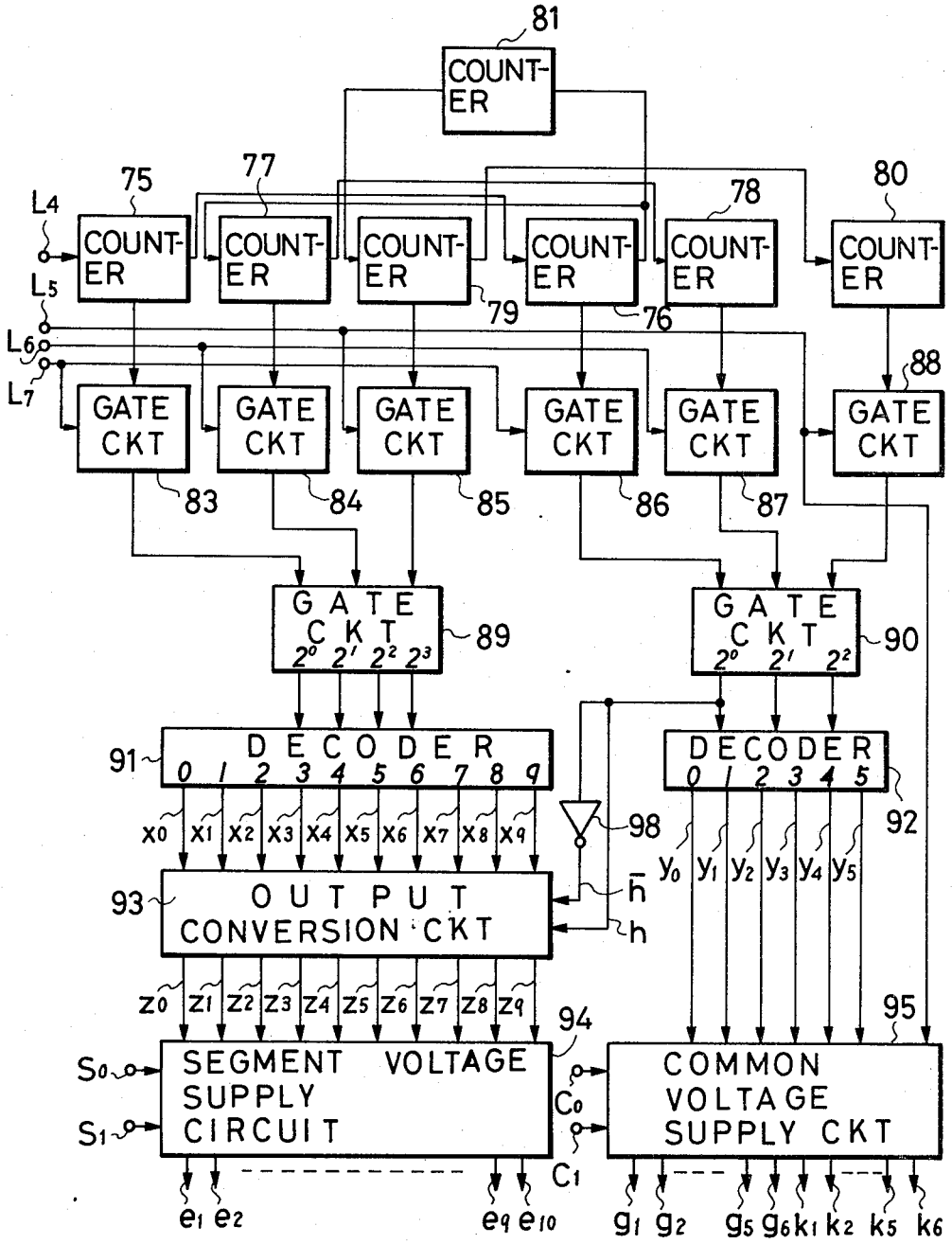

Below is illustrated the display of time by three hands. In FIGS. 9 and 10, reference numerals 75 and 76 represent a decimal counter and a divide-by-six counter for counting seconds digits, 77 and 78 represent a decimal counter and a divide-by-six counter for counting minute digits, and 79 and 80 represent a decimal counter and a divide-by-six counter for counting hour digits. The above-mentioned counters produce outputs in binary coded decimal format. Reference numeral 81 represents a duodecimal counter. A timing pulse generator 82 successively produces pulses to terminals $P_1$ to $P_3$ responsive to output pulses from the frequency divider 2. Gate circuits 83 to 88 having AND logic function are controlled by pulses that are successively fed to the terminals $P_1$ to $P_3$. The outputs of gate circuits 89 and 90 having OR logic function are fed to decoders 91 and 92 which convert the output codes. Reference numeral 93 denotes an output conversion circuit for changing the order of outputs of the decoder 91 responsive to an output of the gate circuit 90. Reference numeral 94 denotes a segment voltage supply circuit which will be described later in detail.

Reference numeral 95 represents a common voltage supply circuit for selecting voltages that are to be applied to the common electrodes, 96 denotes a flip-flop circuit, and 97 denotes a voltage selector which periodically produces predetermined voltages 0, $v_0$, $2v_0$ and $3v_0$ at the terminals $S_0$, $S_1$, $C_0$ and $C_1$. Reference numeral 98 denotes an inverter. Here, the same reference numeral as those of FIGS. 1 and 2 denote the same members as those of FIGS. 1 and 2.

Figure 11:
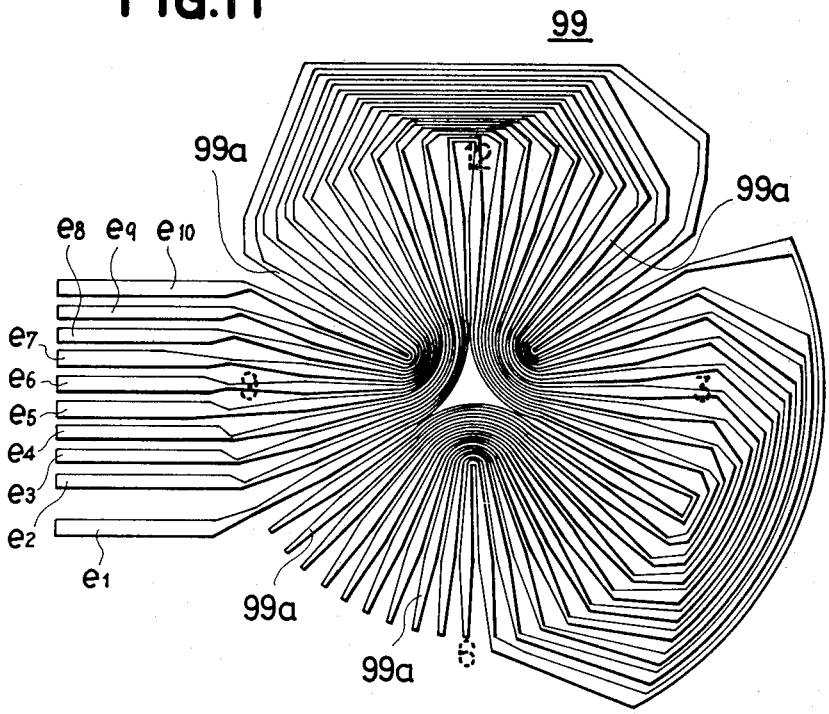
FIG. 11 is a plan view showing an array pattern of segment electrodes.
Figure 12:
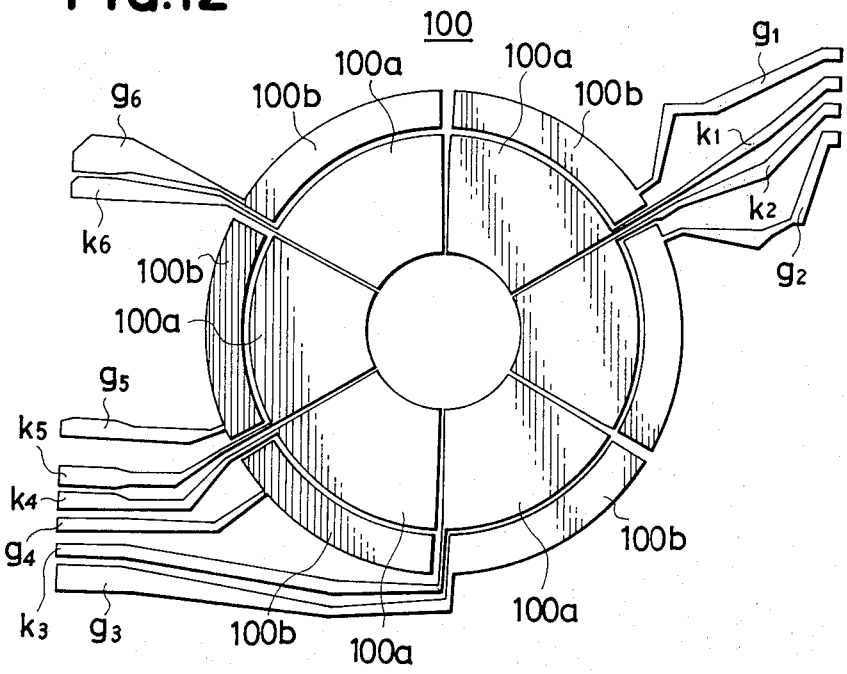
FIG. 12 is a plan view showing an array pattern of common electrodes.

FIGS. 11 and 12 illustrate patterns 99 and 100 of segment electrodes and common electrodes, and their wiring patterns. FIG. 11 shows 60 segment electrodes 99*a* which are wired in the same manner as in FIG. 3 with the exception that the number of segment electrodes in one group is changed from 12 to 10.

FIG. 12 illustrates common electrodes 100*a* and 100*b* which are divided into six groups in a circumferential direction, a pair of common electrodes 100*a*, 100*b* being opposed to the segment electrodes of a number of 10. A display device is constituted by segment electrodes, common electrodes and liquid crystal.

Figure 13:
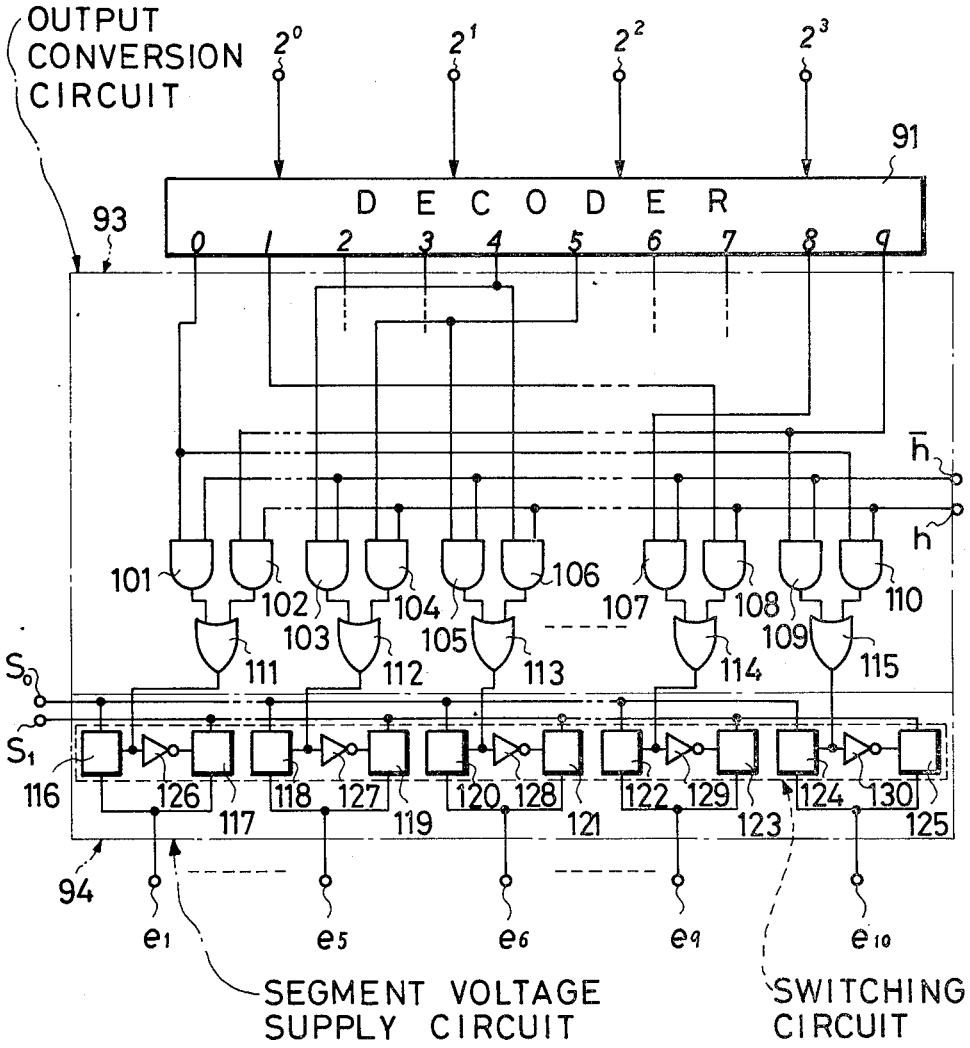
FIG. 13 is a block diagram illustrating in detail an output conversion circuit and a segment voltage supply circuit of FIG. 10.

FIG. 13 shows in detail the output conversion circuit 93 and the segment voltage supply circuit 94, in which reference numerals 101 to 110 denote AND gate circuits, 111 to 115: OR gate circuits, 116 to 125 denote switching circuits which are the same as those of FIGS. 1 and 2, and 126 to 130 denote inverters.

Figure 14:
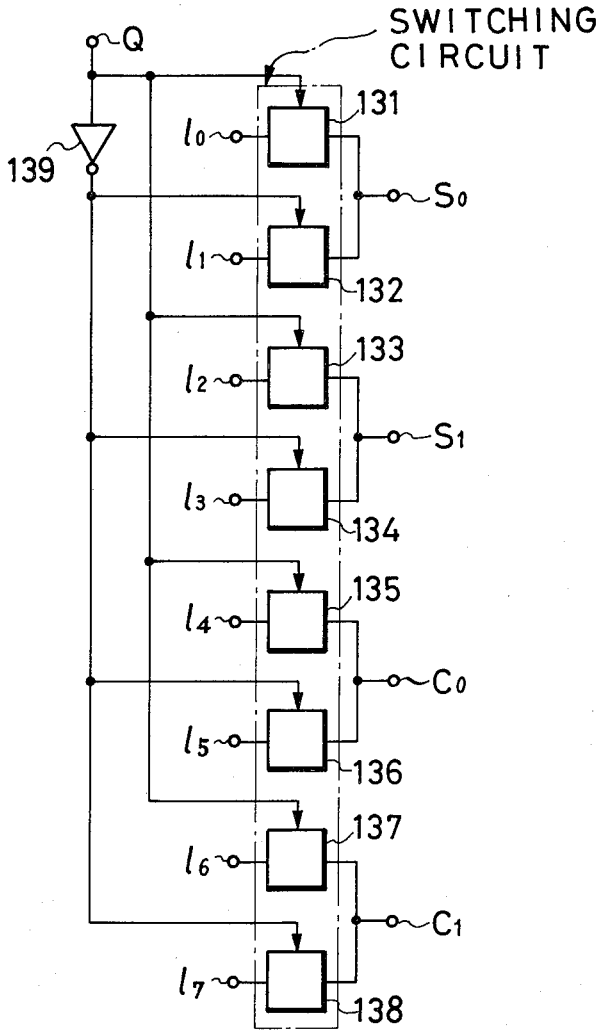
FIG. 14 is a block diagram illustrating in detail a voltage selector of FIG. 9.

FIG. 14 is a diagram showing in detail the voltage selector 97, in which reference numerals 131 to 138 denote switching circuits, and 139 denotes an inverter.

Figure 15:
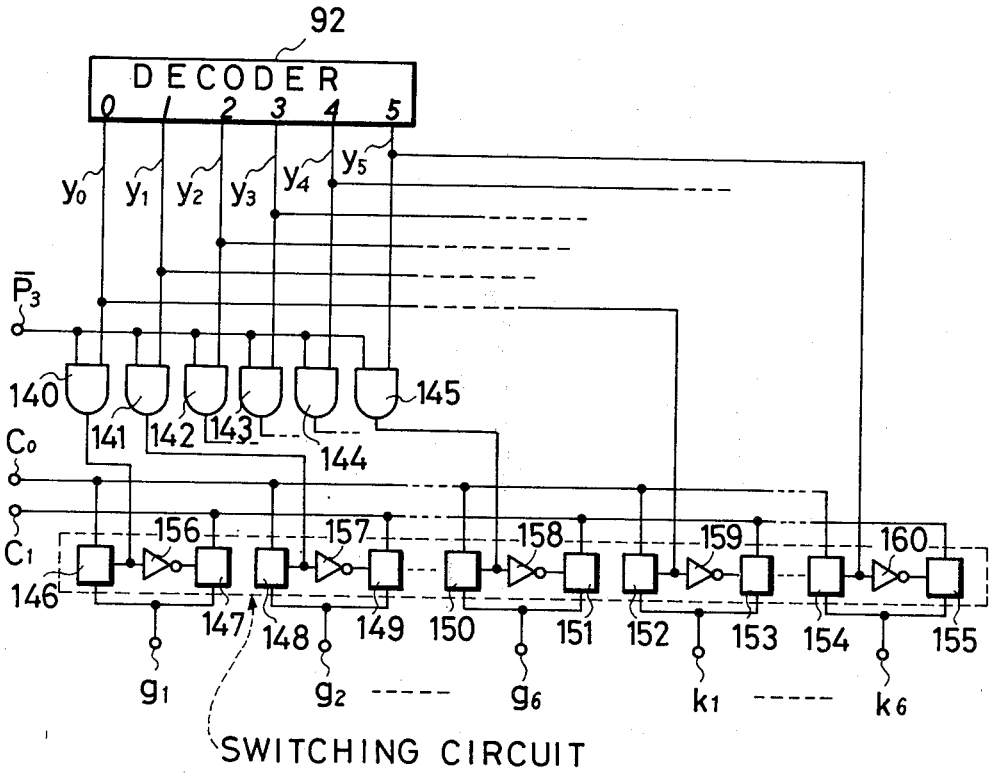
FIG. 15 is a block diagram illustrating in detail a common voltage supply circuit of FIG. 10.

FIG. 15 is a diagram showing in detail the common voltage supply circuit 95, in which reference numerals 140 to 145 represent AND gate circuits, 146 to 155 represent the same switching circuits as those of FIGS. 1 and 2, and 156 to 160 denote inverters.

Figures 16, 17:
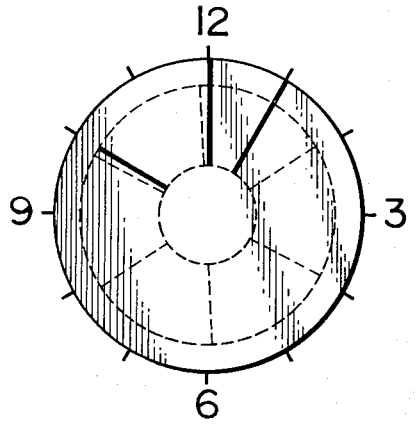
FIG. 16 is a diagram of voltage for illustrating the operation of FIG. 10.
FIG. 17 is a view showing the state in which time is displayed by hands.

Below are illustrated voltages applied to the segment electrodes and to the common electrodes, and voltages between the segment electrodes and common electrodes. Voltages applied to the segment electrodes and the common electrodes are 0, $v_0$, $2v_0$, and $3v_0$. In this embodiment, also, voltages for turning on and turning off the liquid crystal display device are the same as the voltages of the aforementioned embodiment. Referring to FIG. 14, the voltage 0 is applied to terminals $1_1$, $1_4$, the voltage $v_0$ is applied to terminals $1_2$, $1_7$, the voltage $2v_0$ is applied to terminals $1_3$, $1_6$, and the voltage $3v_0$ is applied to terminals $1_0$, $1_5$. As a logic "1" is periodically produced on the terminal $P_1$ of the timing pulse generator 82 of FIG. 9, logic levels "1" and "0" are alternately produced in the output Q of the flip-flop circuit 96. Therefore, voltages 0 and $3v_0$ are alternately produced on the terminal $S_0$, voltages $v_O$ and $2v_0$ are alternately produced on the terminal $S_1$, voltages 0 and $3v_0$ are alternately produced on the terminal $C_0$, and voltages $2v_0$ and $v_0$ are alternately produced on the terminal $C_1$. These relations are shown in FIG. 16 being arranged in the same manner as in FIG. 7. As is obvious from FIG. 16, when voltages are applied to the terminals $S_0$ and $C_0$, a corresponding display portion is turned on.

Below is described the display of time by hands when the counters 75 to 80 of FIG. 10 have counted a time of 5 seconds past zero minute past 10 o'clock. In this case, the counter 75 counts "5", counter 76 counts "0", counter 77 counts "0", counter 78 counts "0", counter 79 counts "0", and counter 80 counts "5". As the pulses are periodically produced on the terminal $P_1$ of the timing pulse generator 82 of FIG. 9, gate circuits 83, 86 of the digits of second are opened, whereby seconds data of the counter 75 is fed to the gate circuits 89, and seconds of the counter 76 is fed to the gate circuit 90. Accordingly, a logic level "1" is produced on the terminals of $2^0$ and $2^2$ of the gate circuit 89, and a logic level "0" is produced on the terminals of $2^0$ to $2^2$ of the gate circuit 90. Consequently, a level of a terminal $\overline{h}$ comes to a logic "1", a level of a terminal h comes to a logic "0", and that of a terminal $x_5$ of the decoder 91 comes to a logic "1". Referring to FIG. 13, therefore, since the gate circuits 105 and 113 produce outputs of a logic level "1", a voltage produced on the terminal $S_0$ is applied to the terminal $e_6$. As a result of the switching circuits 117, —119, 123, —125 turning on, a voltage on to the terminal $S_1$ is produced on each of other terminals $e_1$ to $e_5$ and $e_7$ to $e_{10}$.

Referring to the decoder 92, the output of a logic "1" is produced on the terminal $y_0$, so that a voltage produced on the terminal $C_0$ is applied to the terminal $k_1$ of FIG. 15. Further, since no pulse is produced on the terminal $P_3$ of the timing pulse generator 82 of FIG. 9, that is to say, a level thereof is a logic level "0", a level of the terminal $\overline{P}_3$ is kept at a logic level "1", therefore gate circuits 140 to 145 of FIG. 15 are opened. Accordingly, the switching circuit 146 is turned on, and a voltage produced on the terminal $C_0$ is applied to the terminal $g_1$. A voltage produced on the terminal $C_1$ is applied to the other terminals $k_2$ to $k_6$ and $g_2$ to $g_6$. As a result, the display portion is turned on when a voltage is applied to the terminal $e_6$ and the terminals $g_1$ and $k_1$.

Next, when the pulses are periodically generated on the terminal $P_2$ of the timing pulse generator 82, gate circuits 84, 87 of FIG. 10 are opened to permit the passage of data "0" of the counters 77, 78. Therefore, a level of the terminal $x_0$ of the decoder 91 comes to be a logic "1", that of the terminal $y_0$ of the decoder 92 comes to be a logic "1", the level of the terminal $\bar{h}$ maintains logic "1", and the level of the terminal h maintains logic "0".

Therefore, the gate circuit 111 of FIG. 13 produces a logic level "1", the switching circuit 116 is turned on, and a voltage produced on the terminal $S_0$ is applied to the terminal $e_1$. A voltage produced on the terminal $S_1$ is applied to other terminals $e_2$ to $e_{10}$.

From FIG. 16, a voltage produced on the terminal $C_0$ is applied to the terminals $g_1$, $k_1$, and a voltage produced on the terminal $C_1$ is applied to other terminal $g_2$ to $g_6$ and $k_2$ to $k_6$. From Table of FIG. 16, therefore, a display portion corresponding to the terminal $e_1$ and terminals $g_1$, $k_1$ is turned on.

Furthermore, pulses which are periodically generated on the terminal $P_3$ of the timing pulse generator 82 cause the gate circuits 85, 88 of FIG. 11 to be opened, so that outputs of the counters 79, 80 are allowed to pass therethrough. This causes a voltage produced on the terminal $S_0$ to be applied to the terminal $e_{10}$ of the segment voltage supply circuit 94. A voltage produced on the terminal $C_0$ is applied to the terminal $k_6$ of the common voltage supply circuit 95, and a voltage produced on the terminal $C_1$ is applied to the other terminals $k_1$ to $k_5$. When a pulse is produced on the terminal $P_3$, the outputs of the gate circuits 140 to 145 of FIG. 15 are all logic level "0" and hence, a voltage produced on the terminal $C_1$ is applied to the terminals $g_1$ to $g_6$.

Consequently, a display portion corresponding to the terminals $e_{10}$ and $k_6$ is turned on. FIG. 17 shows the state in which a time is displayed by hands according to the described embodiment.

According to the present invention as mentioned in detail in the foregoing, the segment electrodes are divided into groups, segment electrodes located at predetermined positions in each of the groups are commonly connected together, and pulses are selectively supplied, responsive to time-divided display information, to a hand display portion which comprises the segment electrodes and the divided common electrodes. Therefore, the number of terminals can be reduced relative to the number of the segment electrodes, presenting increased reliability as well as great convenience when the device is to be connected to another circuit system. Furthermore, the increased operation margin assures reduced crosstalk, increased response speed and increased stability over a wide range of temperatures. Besides, the display device of the present invention which is constructed in the same way as the conventional hand-type timepieces, assures quick reading of time. Further, the display device consumes less electric power since it is semi-statically operated for each information unit instead of being dynamically operated for each common electrode. It will be seen that the order that the decoder 14 outputs are selected depends upon the relative logic levels of X and $\bar{X}$. For example, when $\bar{X}$="1" gate 38 will develop decoder 16 output 0, and when $\bar{X}=0$ gate 38 will develop decoder 16 output 11.

In addition, since the display portion is turned on for each unit information, the quantity of information which is to be simultaneously displayed is maintained constant even when the total quantity of information is increased, making it possible to display the information without the need of changing the preset voltage levels.

What is claimed is:

1. An electronic timepiece in which display elements in the shape of second, minute and hour hands are enabled to display at the same time, comprising:

an optical display device having a number of separate display elements in the shape of hands and including electrodes comprised of a number of segment electrodes in the shape of hands arranged extending radially from a point, and common electrodes formed in at least two concentric rings and divided into sectorlike electrodes each of which opposes a group of an equal number of the segment electrodes, means comprised of circuit paths for connecting a corresponding segment electrode in each of the groups without crossing one another, and optical display material between the segment electrodes and the common electrodes;

time counting means receptive of clock pulses for generating a time-count-output representing at least seconds, minutes and hours;

a timing pulse generator for generating timing pulses;

a selection circuit receptive of timing pulses for generating time-divisionally each time unit of the time-count-output in synchronization with the timing pulses;

first means for decoding one place of each time unit of the time-count-output generated by the selection circuit to logical values for selecting a set of connected corresponding segment electrodes;

second means for decoding a second place of each time unit of the time-count-output generated by the selection circuit to logical values for selecting a sector-like electrode;

converting means for changing the order of the output from the first means in accordance with whether the number of the second place-output selected by the selection circuit is an even number or odd number;

a segment voltage supply circuit for applying selectively the voltages 0, $V_0$, $2V_0$ and $3V_0$ to the respective segment electrodes in accordance with the output from the second means; and a common voltage supply circuit for applying selectively the voltages 0, $V_0$, $2V_0$ and $3V_0$ to the respective section-like electrodes, so as to periodically apply to the display element to be turned ON the voltage $|3V_0|$ between each segment electrode and each sector-like electrode and so as to periodically apply to the display element to be turned OFF the voltage $|V_0|$ between each segment electrode and each sector-like electrode.

2. An electronic timepiece according to claim 1, wherein said converting means is comprised of: a plurality of gate circuits each having a first and a second input terminal and each having a pair of control terminals for receiving control signals to select between the first and second input terminals thereof so as to pass an input signal applied to the selected input terminal; means comprised of conductive circuit paths for connecting the first input terminal of each gate circuit to receive a corresponding output signal of said first means with said gate circuits ordered from a lowest valued first means output signal to a highest valued first means output signal; means comprised of conductive circuit paths for connecting the second input terminal of each gate circuit to receive a corresponding output signal of said first means with said gate circuits ordered from the highest valued first means output signal to the lowest valued first means output signal; and means for applying output signals from said second means to said control terminal pairs of said gate circuits for changing the order of said first means outputs according to whether the number of the second placeoutput selected by the selection circuit is an even number or odd number.

* * * * *